US006972362B2

(12) United States Patent
Nakamura

(10) Patent No.: US 6,972,362 B2
(45) Date of Patent: Dec. 6, 2005

(54) METHOD AND DEVICE FOR GENERATING ELECTRONIC SOUNDS AND PORTABLE APPARATUS UTILIZING SUCH DEVICE AND METHOD

(75) Inventor: Yutaka Nakamura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 196 days.

(21) Appl. No.: 10/338,269

(22) Filed: Jan. 7, 2003

(65) Prior Publication Data

US 2003/0128102 A1 Jul. 10, 2003

(30) Foreign Application Priority Data

Jan. 9, 2002 (JP) ..... 2002-002071
Jan. 9, 2002 (JP) ..... 2002-002072

(51) Int. Cl.[7] ..... G10H 7/00
(52) U.S. Cl. ..... 84/603; 84/604; 84/609; 84/618
(58) Field of Search ..... 84/600–609, 615, 84/618, 622–625

(56) References Cited

U.S. PATENT DOCUMENTS 4,395,931 A * 8/1983 Wachi ..... 84/603
5,342,990 A * 8/1994 Rossum ..... 84/603
5,689,079 A * 11/1997 Kosugi ..... 84/603
5,698,803 A * 12/1997 Rossum ..... 84/607
5,744,741 A * 4/1998 Nakajima et al. ..... 84/622
5,925,841 A * 7/1999 Rossum ..... 84/603
6,137,043 A * 10/2000 Rossum ..... 84/603

FOREIGN PATENT DOCUMENTS

JP 2001-242878 9/2001

* cited by examiner

*Primary Examiner*—Marlon Fletcher
(74) *Attorney, Agent, or Firm*—Hogan & Hartson LLP

(57) ABSTRACT

An electronic sound generation device is adapted to start arithmetic processing with a start signal. When the arithmetic processing is not completed in a period between two sampling signals of a constant period, a start signal for starting next arithmetic processing signal for the next period is output after the completion of the on-going arithmetic processing. The electronic sound generation device is also adapted to hold resultant data of arithmetic processing, which is output in synchronism with the sampling signal. An address for designating waveform data in a waveform memory is calculated upon the address arithmetic parameters received from a digital signal processor (DSP) having a sum-of-products arithmetic circuit. Using fractional parts of the addresses, the data read out from the waveform memory are interpolated, and supplied to the DSP.

4 Claims, 9 Drawing Sheets

METHOD AND DEVICE FOR GENERATING ELECTRONIC SOUNDS AND PORTABLE APPARATUS UTILIZING SUCH DEVICE AND METHOD

FIELD OF THE INVENTION

This invention relates to a method and a device (referred to as electronic sound generation method and device) for generating electronic sounds for performing music using waveform data stored in a memory device, and to a portable apparatus (e.g. cellular phones, synthesizers, PDAs, and the like) utilizing such method and device.

BACKGROUND OF THE INVENTION

Conventional methods of generating electronic sounds using waveform data stored in a memory device include a method in which all of the necessary arithmetic processing is performed by built-in hardware components, and a method in which arithmetic is performed by software using a digital signal processing unit such as a digital signal processor (DSP). In recent years, in order to provide capability of simultaneously generating an increased number of tones and to provide varied acoustic effects, contents and order of arithmetic processing have become complex. However, it is difficult to configure hardware to execute all the arithmetic processing in view of limitations in time and freedom in the design and modification of hardware.

On the other hand, a program can be developed to deal with complex arithmetic processing using a digital signal processing unit, so that software methods have been used more often.

FIG. 1 is a block diagram representation of a conventional electronic sound generation device using a digital signal processing unit. FIG. 2 is a timing diagram showing operations of the device.

As shown in FIG. 1, a digital signal processor (DSP) 20 has a digital signal processing circuit 201, a sampling signal generation circuit 202, and an output circuit 203 for outputting the result of arithmetic processing (the output circuit will be referred to as arithmetic result output circuit). The digital signal processing circuit 201 receives, from a waveform memory 40 such as a ROM, predetermined musical sound waveform data stored therein, along with various control commands including sound parameters for simulating different kinds of musical instruments and for designating musical scales from a system control section 10 composed of a host CPU.

The digital signal processing circuit 201 starts arithmetic processing of the waveform data and sound parameters in synchronism with a sampling signal i of a constant period T received from the sampling signal generation circuit 202. The digital signal processing circuit 201 carries out prescribed arithmetic processing to obtain the resultant data (or sound data) to be supplied to the arithmetic result output circuit 203.

The sampling signal i is periodically output with the constant period T (resulting in periods of time T1–T7 in FIG. 2). The prescribed arithmetic processing is carried out. In the respective periods T. This period T is, for example, 22.7 $\mu$s (=1/44.1 kHz) in the case of compact disk (CD). Upon receipt of a sampling signal i, the digital signal processing circuit 201 starts the processing, and feeds the resultant data v of the arithmetic processing to the arithmetic result output circuit 203 at the end (time t1'–t7') of that processing. The resultant data is temporarily held in the arithmetic result output circuit 203, and outputted from the arithmetic result output circuit 203 as sound data vi in synchronism with a next sampling signal i. A signal iii shown in FIG. 2 represents a signal indicating that the arithmetic processing is in progress when the level of the signal is high.

The amount of operations that can be done within a sampling period T depends on the length of the period T and the operating frequency of the LSI in which the sound generation device is formed. Referring to FIG. 2, an arithmetic processing is initiated by a sampling signal i received at time t1. The arithmetic processing is normally completed at time t1' say, within the period T1. In the example shown in FIG. 2, a further arithmetic processing is started by another sampling signal i at time t2. It is seen in FIG. 2 that this processing is not completed within a period of T2 and continued until it is completed at time t2' in the next period T3. In this case, the resultant data of the arithmetic processing will be outputted in synchronism with the sampling signal i given at time t4. It is noted that the sound data already output at time t2 is again output at time t3.

Afterwards, the arithmetic processing that should have been done in the period T3 would be processed in the period T4. The same is true in the subsequent periods T5 and after. That is, arithmetic processing that was not done in the preceding periods, if any, will be done in the subsequent periods. In this way, if arithmetic processing was not completed in a predetermined period, it is continued in the subsequent period, delaying the arithmetic processing that should have been done in that subsequent period. Thus, the delay of the arithmetic processing would be accumulated every time the processing is not completed in each period.

Hence, in order to prevent a large delay of an entire musical piece due to accumulative delays in the arithmetic processing, a maximum amount of arithmetic processing was not allowed to exceed the sampling period T.

One way to circumvent this problem is to lower the sampling frequency to have a longer sampling period T or to increase the amount of operations in the arithmetic processing per unit time.

However, in order to generate enriched timbres, it is necessary to have a high sampling frequency, so that it is not preferred to lengthen the sampling period T. Also, increasing the amount of arithmetic processing per unit time is not desirable since it requires a higher operational frequency of the LSI used, which disadvantageously results in increased power consumption by the LSI and an increased substrate area for the LSI. Thus, this approach is difficult to apply particularly to a portable device.

A conventional DSP has, as its main component, a sum-of-products arithmetic circuit for processing waveform data using its arithmetic resources. Moreover, the DSP is generally adapted to calculate addresses (by address arithmetic) of the internal working memory and an external memory storing waveform data.

The sum-of-products arithmetic circuit of such a DSP is designed to execute signal processing (such as convolution operation of IIR filtering and FIR filtering) at a high speed. Therefore, if the DSP is used for the special operations other than the intended signal processing, for example processing of modulo operations and address generation that involves memory address jumps, the operational efficiency of the DSP will become much lowered.

Therefore, it has been proposed in recent sound signal processing DSPs to provide a circuit arrangement in which address generation can be done without imposing a heavy load on the sum-of-products arithmetic circuit. (See for example, Japanese Patent Application Early Publication No. 2001-242878, which will be referred to as prior art.)

However, the prior art performs address arithmetic processing of an external memory in the DSP, and utilizes waveform data stored in the external memory as it is. Thus, the prior art DSP has a drawback in that it must have a huge external memory for storing all necessary waveform data for use in generating various timbres encountered in the performance of music. Further, the prior art DSP has another drawback that it cannot provide waveform data other than those stored in the external memory.

In addition, it is difficult for the prior art DSP to generate richer timbres in energy-effective devices, especially portable devices, because in these devices a high operational frequency for fast arithmetic processing is not usable to suppress their power consumption.

SUMMARY OF THE INVENTION

It is therefore an object of the invention to provide an electronic sound generation device for use in performing music using waveform data stored in a memory device, in which a sound having rich timbre can be generated without extending a sampling period or raising the operating frequency of the device.

It is another object of the invention to provide such an electronic sound generation device as mentioned above particularly suitable for use with a portable device.

It is still another object of the invention to provide an electronic sound generation device for use in the performance of music using waveform data stored in a memory device, in which a process of calculating a memory address of stored waveform data is carried out by an address arithmetic unit provided separately from a digital signal processing unit in order to improve the throughput of the digital signal processing unit.

It is a further object of the invention to provide means for generating various kinds of musical signals using a relatively small memory.

It is a still further object of the invention to provide means for generating sounds having rich timbres.

In accordance with one aspect of the invention, an electronic sound generation method comprises steps of:

starting predetermined arithmetic processing of waveform data based on sound parameters upon receipt of a start signal for starting arithmetic processing (referred to as start arithmetic signal);

outputting resultant data of said arithmetic processing upon completion of said arithmetic processing; and when said predetermined arithmetic processing is completed within a constant period of a sampling signal, issuing a start signal for starting next arithmetic processing in synchronism with the immediately subsequent sampling signal, but when said predetermined arithmetic processing is not completed within said period, issuing a start signal for starting next arithmetic processing when said predetermined arithmetic processing is completed.

In accordance with another aspect of the invention, a sound generation device comprises:

a waveform memory for storing waveform data;

a digital signal processing circuit for starting, upon receipt of a start arithmetic signal, predetermined arithmetic processing based on sound parameters and waveform data supplied from said waveform memory, outputting a signal (referred to as in-operation signal) indicating that said digital signal processing circuit is in operation during said arithmetic processing, and outputting resultant data of said arithmetic processing when said arithmetic processing is completed;

a sampling signal generation circuit for periodically outputting a sampling signal with a constant period;

a synchronized ON/OFF circuit receiving said periodic sampling signal and said in-operation signal, said ON/OFF circuit adapted to supply said digital signal processing circuit with a start signal for starting next arithmetic processing in synchronism with said sampling signal when said predetermined arithmetic processing has been completed at the time said sampling signal is received but otherwise supply said start signal after said predetermined arithmetic processing is completed; and an arithmetic result output circuit for holding said resultant data of arithmetic processing supplied from said digital signal processing circuit and for outputting said resultant data as a sound data in synchronism with said sampling signal.

In accordance with the invention, it is possible to generate richer timbres than those of prior art by executing an excessive arithmetic processing extending over a given sampling period in a subsequent sampling period having less amount of arithmetic processing, thereby resulting in only negligible delay for the entire musical piece.

In accordance with another aspect of the invention, an electronic sound generation device comprises:

a digital signal processing device including a sum-of-products arithmetic circuit;

a waveform memory;

a waveform memory address arithmetic circuit for calculating, upon receipt of address arithmetic parameters from said digital signal processing device, the address to be designated in said waveform memory; and a waveform data interpolation circuit for interpolating data read from said waveform memory and supplying interpolated data to said digital signal processing device.

An electronic sound generation device of the invention enables generation of various timbres using data other than the waveform data stored in a waveform memory means by means of a general-purpose DSP. To do this, the invention reads out from the waveform memory waveform data addressed by integral parts (upper bits) of the resultant data of the arithmetic and interpolates the waveform data based on the fractions below decimal point (lower bits) of the resultant data.

DETAILED DESCRIPTION OF THE PREFERRED EMBODIMENT

The invention will now be described in detail by way of example with reference to the accompanying drawings.

Figure 1:
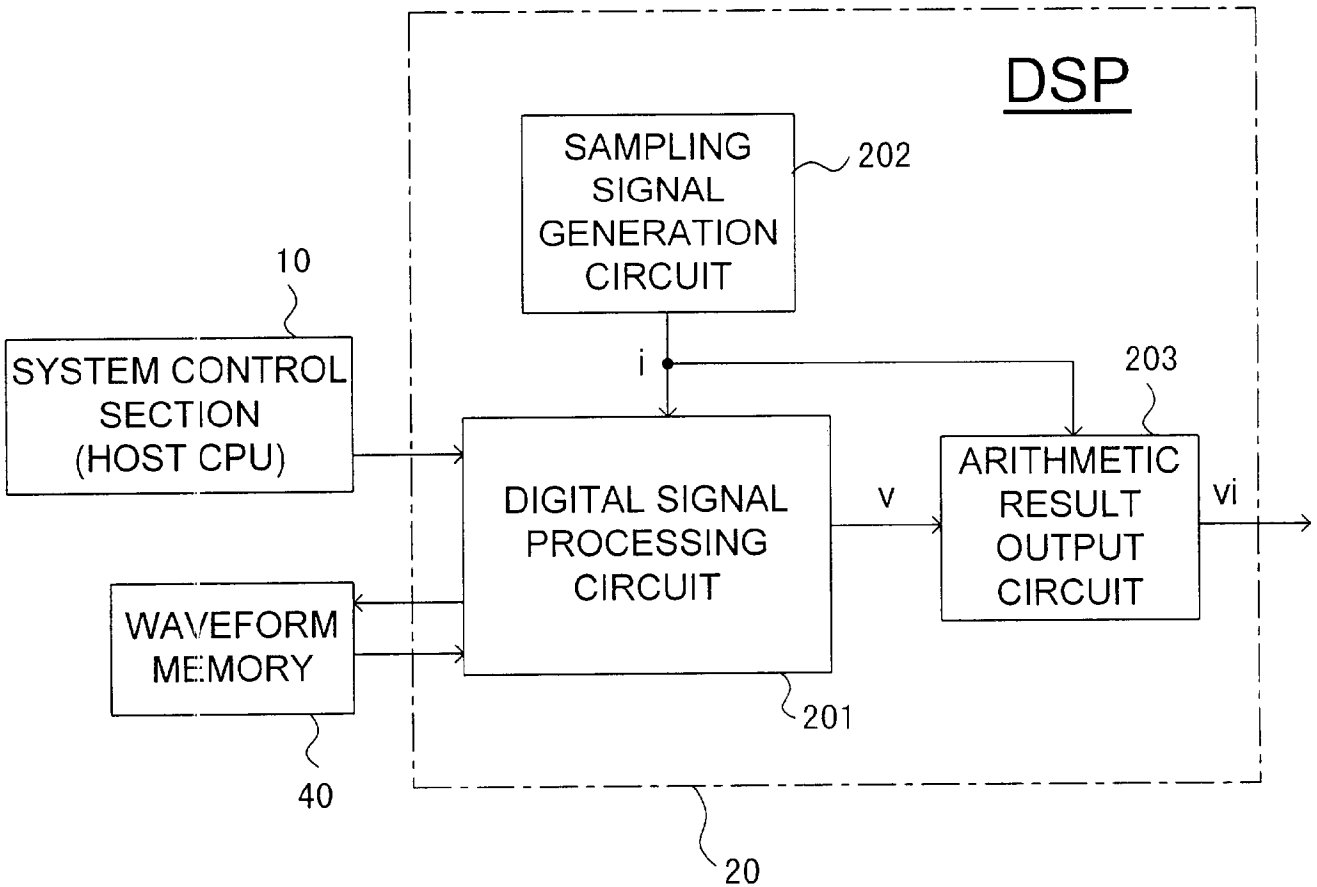
FIG. 1 PRIOR ART
FIG. 1 is a block diagram representation of a conventional electronic sound generation device.
Figure 2:
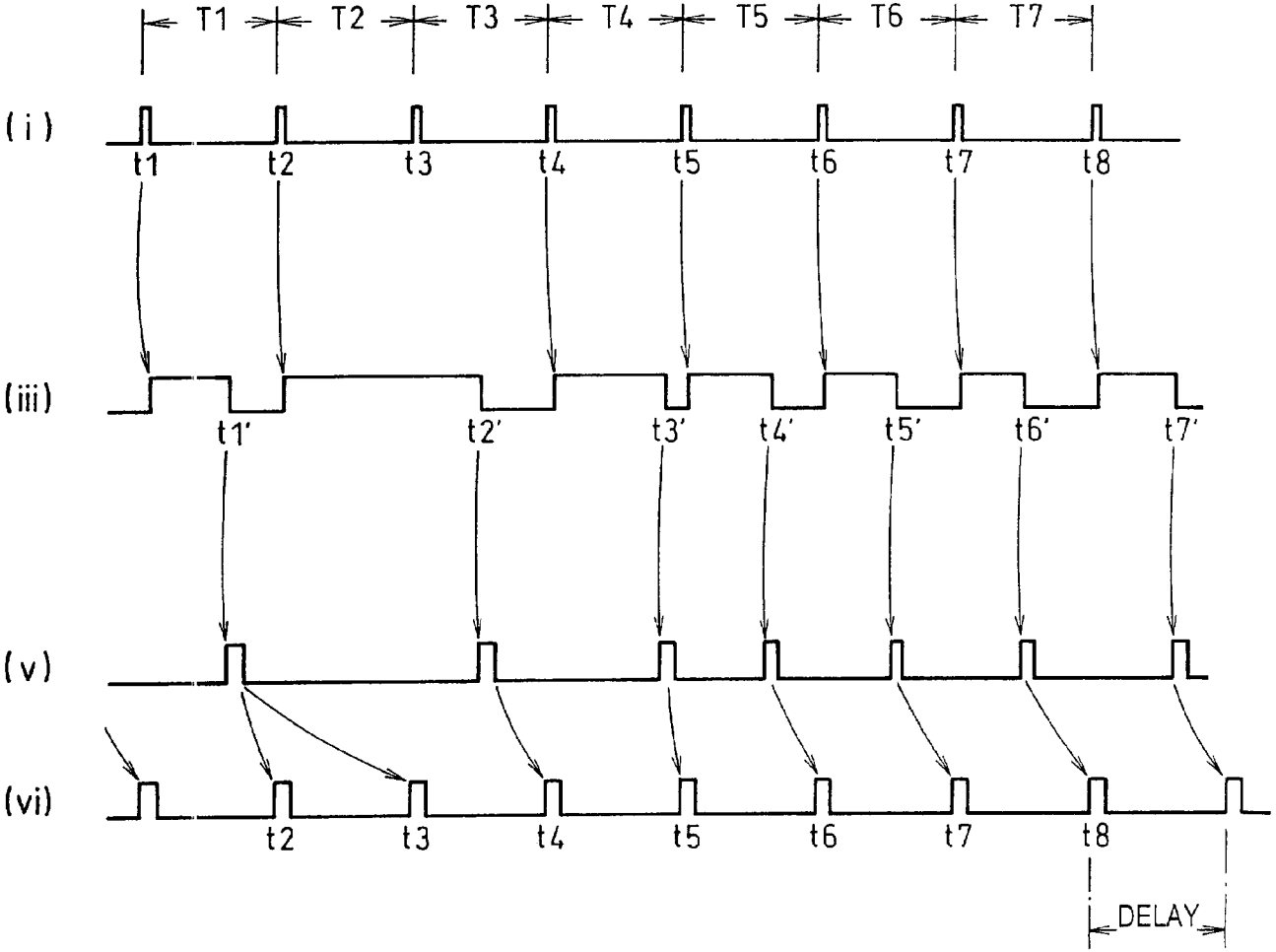
FIG. 2 PRIOR ART
FIG. 2 is a timing diagram of the device shown in FIG. 1.
Figure 3:
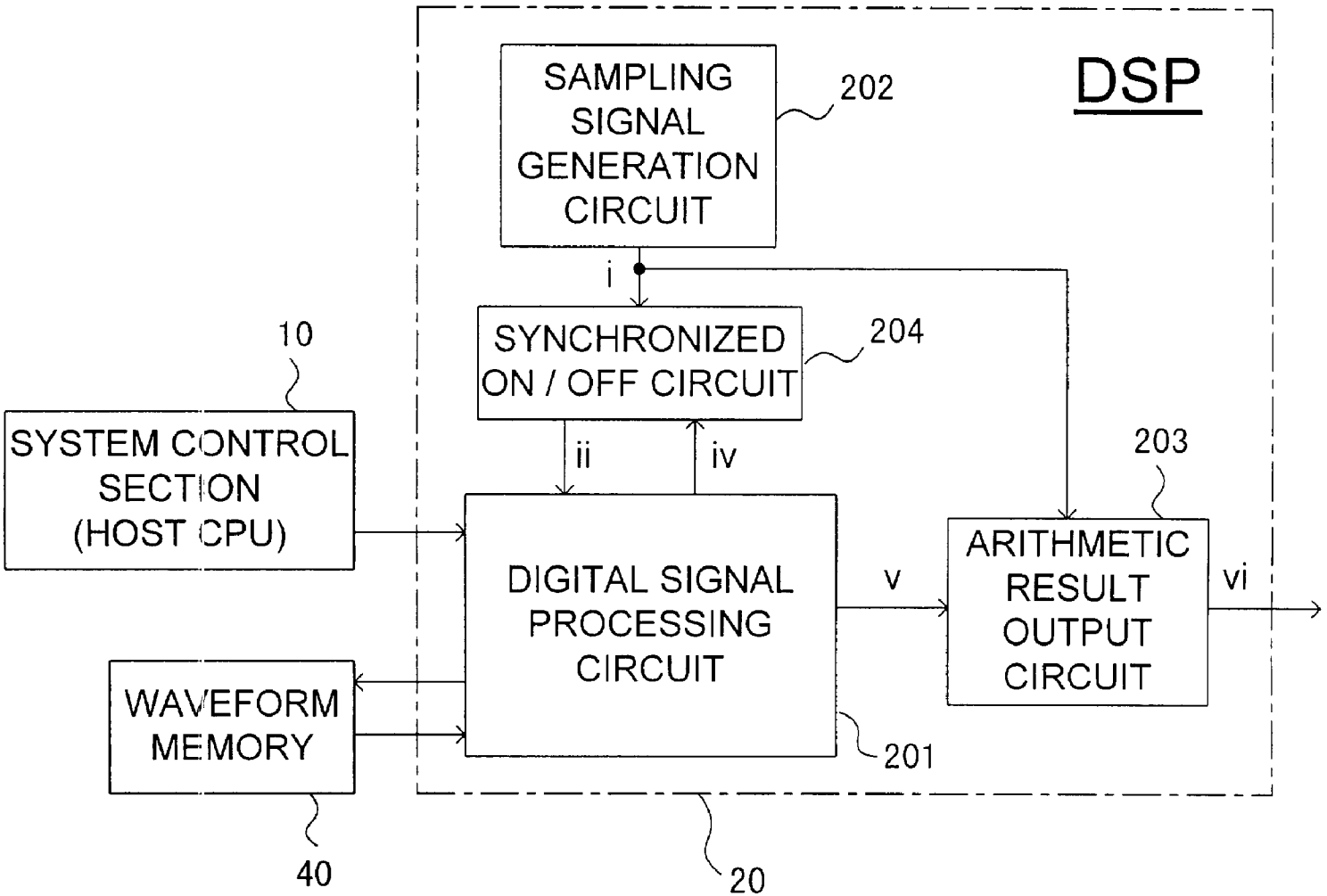
FIG. 3 is a block diagram representation of a first embodiment of an electronic sound generation device according to the invention.
Figure 4:
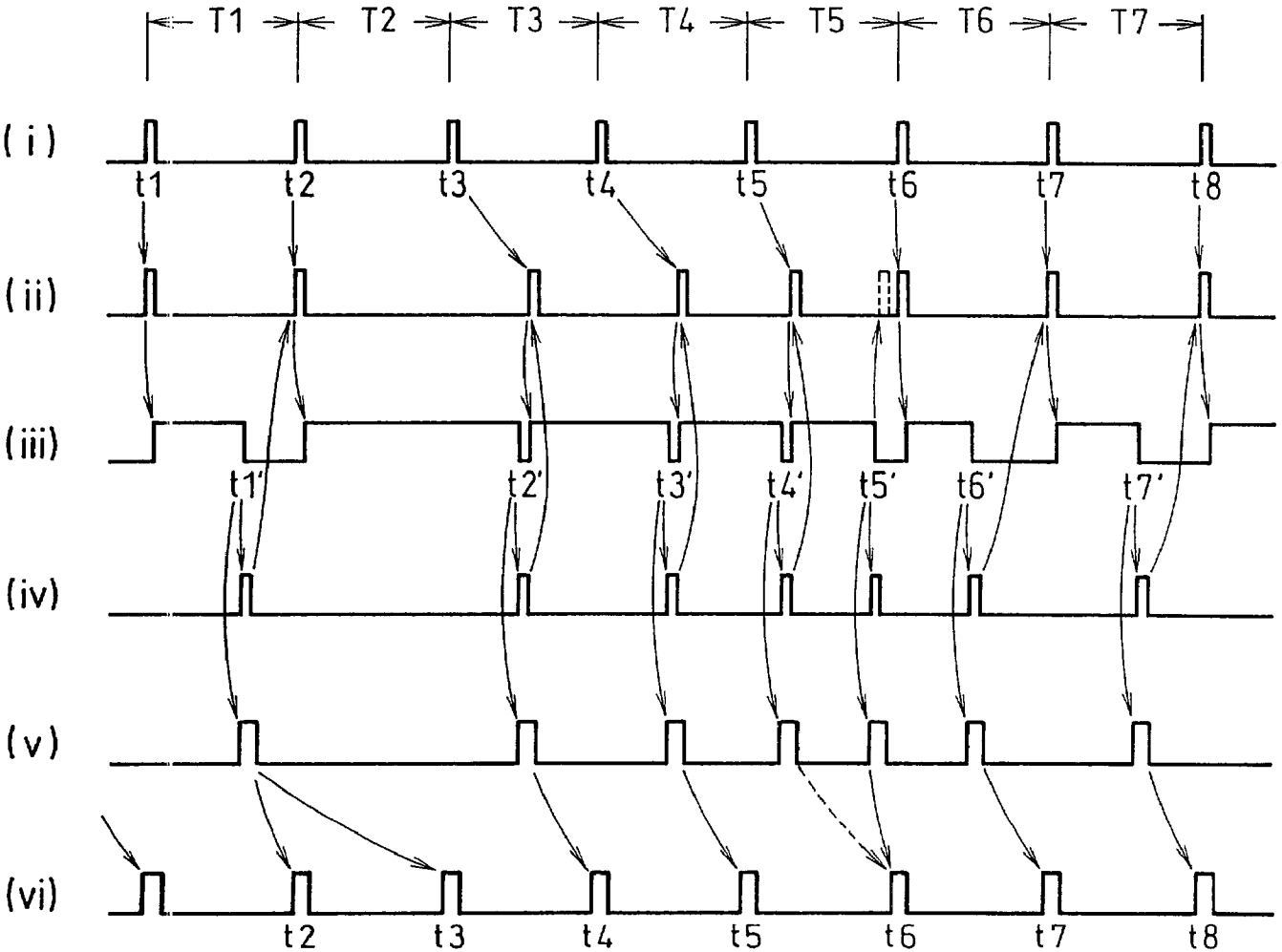
FIG. 4 is a timing diagram of the device of FIG. 3.

Referring to FIG. 3, there is shown a first embodiment of an electronic sound generation device of the invention. FIG. 4 is a timing diagram of the device.

The electronic sound generation device shown in FIG. 3 comprises, as its measure components, a system control section 10, a waveform memory 40, and a digital signal processor (DSP) that includes a digital signal processing circuit 201, a synchronized ON/OFF circuit 204, a sampling signal generation circuit 202, and an arithmetic result output circuit 203. These components are controlled by a controller (not shown) such as a CPU.

The system control section 10, comprising a host CPU, is adapted to feed various commands that contain various sound parameters representing various types of musical instruments, musical scales, and the like to the digital signal processing circuit 201.

The waveform memory 40, typically a ROM, stores PCM sound data (hereinafter also referred to as waveform data) that have been supplied via an input/output means (not shown). The waveform data for different musical instruments are allocated at different locations of the waveform memory 40 addressable in association with corresponding musical instruments.

The digital signal processing circuit 201 performs predetermined arithmetic operations or processing based on the sound parameters and waveform data input thereto. The arithmetic processing of the digital signal processing circuit 201 is started by a start arithmetic signal ii received from the synchronized ON/OFF circuit 204 and carries out a bundle of arithmetic operations to output sound data. With the completion of the arithmetic processing of the bundle of operations, the digital signal processing circuit 201 issues an end arithmetic signal iv to the synchronized ON/OFF circuit 204, and supplies resultant data v of the arithmetic processing to the arithmetic result output circuit 203. It will be understood that the digital signal processing circuit 201 may output a signal iii indicating that the arithmetic operation is in process together with, or in place of, the end arithmetic signal iv.

The sampling signal generation circuit 202 periodically outputs a sampling signal i with a predetermined period (e.g. 22.7 microseconds) to the synchronized ON/OFF circuit 204 and arithmetic result output circuit 203. The sampling period is set in such a way that the average time of arithmetic processing executed in the digital signal processing circuit 201 will not exceed the sampling period, although the maximum processing time of the arithmetic processing can exceed the sampling period. That is, the sampling period is set to satisfy the following condition:

Maximum arithmetic processing time>Sampling period>Mean arithmetic processing time.

The synchronized ON/OFF circuit 204 is configured to output a start arithmetic signal ii either in synchronism with the input sampling signal i received or after the reception of an end arithmetic signal iv received after the sampling signal i. The timing of issuing the start arithmetic signals ii depends on whether the arithmetic processing of a bundle of operations is completed within a given sampling period or not.

The arithmetic result output circuit 203 is provided with registers for holding the resultant data v of the arithmetic processing which is asynchronously supplied from the digital signal processing circuit 201. The registered data v may be synchronously retrieved therefrom by a synchronized sampling signal i and be output as sound data vi. The register is adapted to hold the data even after the data is read out therefrom, until the data is overwritten by new data received.

Referring now to FIG. 4, operations of the electronic sound generation device of FIG. 3 will be described.

The sampling signal i is periodically generated with a predetermined period of T. There are shown seven periods T1–T7 in FIG. 4. In the first period T1 starting at time t1 at which a sampling signal i is input, the synchronized ON/OFF circuit 204 generates a start arithmetic signal ii in synchronism with the sampling signal i and feeds it to the digital signal processing circuit 201. Upon receipt of the start arithmetic signal ii, the digital signal processing circuit 201 promptly starts arithmetic processing based on the sound parameters and waveform data, and ends the arithmetic processing a predetermined time t1' later. It is noted that the digital signal processing circuit 201 may be configured to provide the synchronized ON/OFF circuit 204 with a signal iii indicating that arithmetic processing is currently in the progress.

At time t1' when the arithmetic processing is finished, an end arithmetic signal iv is supplied to the synchronized ON/OFF circuit 204, and the resultant data v of the arithmetic processing is entered to the arithmetic result output circuit 203 and held therein. The resultant data v held in the arithmetic result output circuit 203 is synchronized with the next sampling signal i, and output at time t2 from the output circuit 203 as the sound data. In this manner, normal arithmetic processing is finished within a given period T1.

Next, since the arithmetic processing was finished in the preceding period T1, start arithmetic signal ii is output at time t2 at the time of issuing the sampling signal i, and the next arithmetic processing is started for the period T2.

It is shown in FIG. 4 that the amount of arithmetic operations is too much to be processed in the period T2, and that it is not completed within the period T2. It is done at time t2' in the subsequent period T3.

In this instant, when the sampling signal i is output at time t3 for the period T3, new resultant data v of the arithmetic processing has not been obtained yet. As a consequence, the arithmetic result output circuit 203 outputs the preceding data stored in the register in place of the new data v. This prevents a hiatus from occurring in the sound data.

When the arithmetic processing is done at time t2', an end arithmetic signal iv is output immediately. When both the end arithmetic signal iv and the sampling signal i are available at time (t3), the start arithmetic signal ii is generated to start the next arithmetic processing for the period T3. At the same time, the resultant data v of the arithmetic processing is output to the arithmetic result output circuit 203 to overwrite the data in the register. The arithmetic data for the period T2 is output at time t4, delayed by 1 period T.

Although the arithmetic processing for the period T3 could be completed in one time interval equal to T, it is finished at time t3' in the period T4, since its start was delayed for some time in the period T3. As the arithmetic processing for the period T3 is finished at time t3', the start arithmetic signal ii is issued to start the arithmetic processing for the period T4. At the same time, the resultant data v of the arithmetic processing is output to the arithmetic result output circuit 203, overwriting the data held in the register. The resultant data of the arithmetic processing for the period T3 is output at t5, delaying for 1 period T.

It is seen in FIG. 4 that the arithmetic processing for the period T4 is significantly short, but it is still extending in the next period T5. As a consequence, when the processing for the period T4 is finished at time t4', the start arithmetic signal ii is output to start the next arithmetic processing in the period T5. At the same time, the resultant data v of the arithmetic processing is output to the arithmetic result output circuit 203 to overwrite the data in the register.

In the period T5, the arithmetic processing that started in the period T4 is finished at time t4' and so is the arithmetic processing for the period T5 before the end of the period T5.

In this case, the end arithmetic signal iv is output to the synchronized ON/OFF circuit 204 at time t5'. That is, the second end arithmetic signal iv is also input to the synchronized ON/OFF circuit 204 in the same period T5. The fact that two end arithmetic signals iv were input in the same period T5 means that the arithmetic processing extending into subsequent periods has been completed in this period, making up the delay.

Accordingly, the two end arithmetic signals iv received in the same period T5 are ignored, thereby generating no start arithmetic signal (as shown by a broken line).

On the other hand, in response to completion of the arithmetic processing at time t5', resultant data v of the arithmetic processing is issued at time t5'. As a consequence, the resultant data of the arithmetic processing output at time t4' is overwritten by the resultant data of the arithmetic processing output at time t5'. Hence, the resultant data output at time t4' will not be output at all as sound data. The resultant data output at time t5' is output as the sound data for the period T5.

For the periods T6–T7, the arithmetic processing for the respective periods is completed in the respective periods, so that the procedure in each of the periods is the same as that for the period T1.

In the first embodiment of the invention as described above, given a sampling period T, the maximum time needed to complete a bundle of arithmetic operations performed in the digital signal processing circuit 201 can exceed the sampling period T, as observed in the period T2. In an event that the arithmetic processing runs into the next period, resulting in delays in the subsequent periods, the arithmetic processing may be absorbed in the subsequent periods. In order to absorb such extended or delayed arithmetic processing, the processing is set up so that the mean arithmetic processing time fits in the sampling period. That is, the mean time is set such that Maximum processing time>Sampling period>Mean time.

In general, in electronic sound generation devices, including the inventive one, the amount of arithmetic operations is large only in the initial stage of processing a sequence of sound data for generating a specific sound involving processing of sound parameters. The frequency of occurrence of such heavy processing is extremely small, probably once in a few thousands-10 thousands. Thus, by allowing a portion of arithmetic processing that exceeds in time a given sampling period to be done in a subsequent period having less arithmetic operations, a rich sound can be generated without causing a delay for the entire piece.

If in the method of the invention arithmetic processing exceeds in time the sampling period T, one sound data is used twice, while another sound data will not be used. However, in the present invention, the sampling period T is set such that it is shorter than the maximum arithmetic processing time for processing a bundle of arithmetic operations but longer than the average arithmetic processing time, so that a delay in any period can be eventually absorbed in the subsequent periods, thereby creating no delay for the piece as a whole.

By setting the sampling period to cover mean arithmetic processing time, instead of conventionally setting the sampling period to cover the maximum arithmetic processing time, it is possible in the present invention to substantially increase the number of executable arithmetic operations, thereby enabling generation of a rich sound. It will be appreciated that the sampling frequency can be raised to improve the quality of the sound in accordance with the invention.

It will be also appreciated that the inventive method can be applied to a device that operates at a low operating frequency, thereby allowing an LSI embodying the invention to operate at a reduced power and have a reduced substrate area. Therefore, the invention is suitable for a miniaturized low-powered portable device.

It will be understood that the system control section 10, waveform memory 40, digital signal processing circuit 201, synchronized ON/OFF circuit 204, sampling signal generation circuit 202, and arithmetic result output circuit 203 can be formed as separate LSIs or built in the same LSI in an arbitrary combination.

Referring to FIGS. 5–9, a second embodiment of the invention will now be described below.

Figure 5:
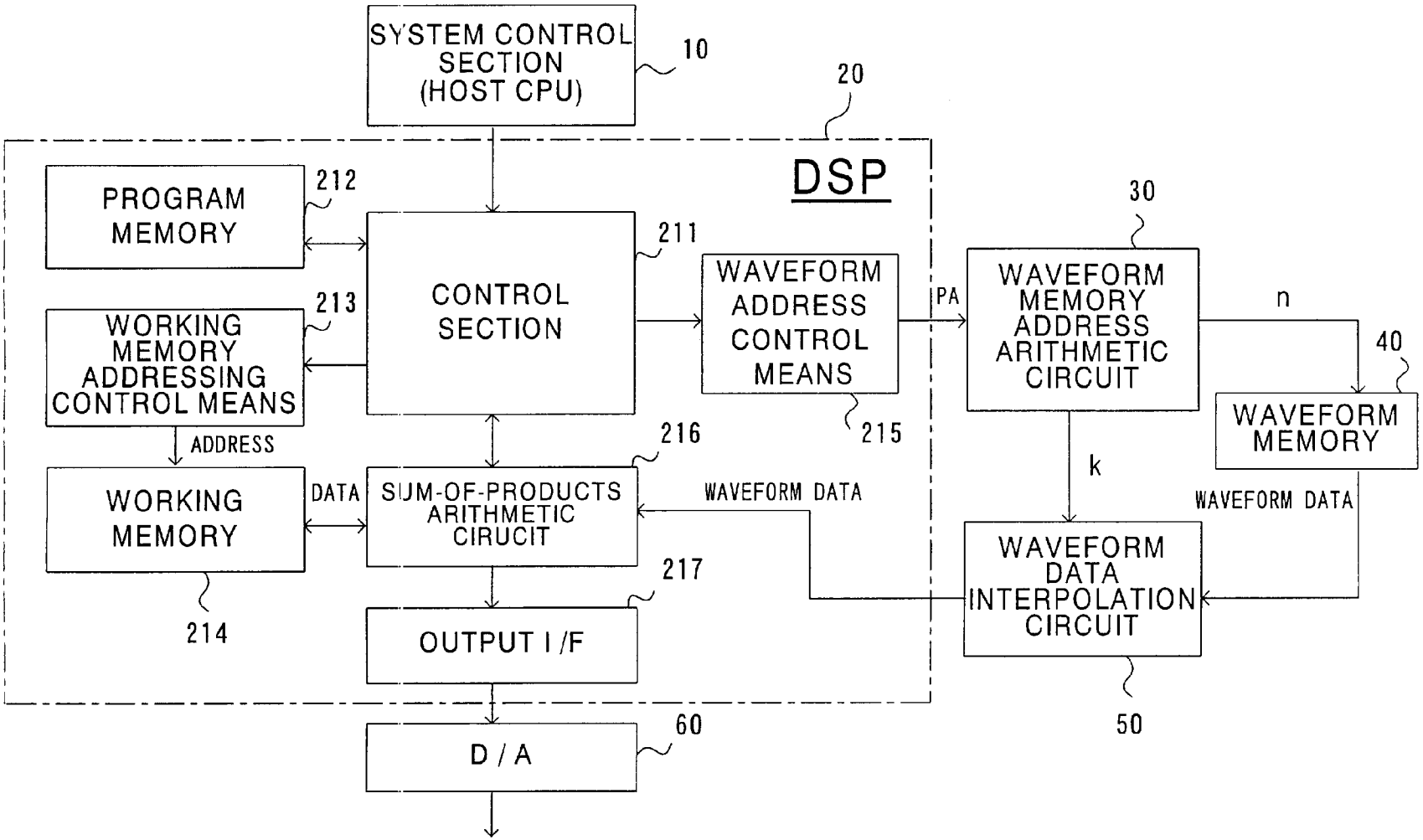
FIG. 5 is a block diagram representation of a second embodiment of an electronic sound generation device according to the invention.

FIG. 5 is a block diagram representation of a second embodiment of an electronic sound generation device according to the invention. The device includes such major components as a system control section 10 comprising a host CPU, a music signal processing DSP 20, a waveform memory address arithmetic circuit 30, a waveform memory 40, a waveform data interpolation processing circuit 50, and a digital to analog (D/A) converter 60.

The system control section 10 controls the components so as to enable the electronic sound generator as a whole to generate and output a desired analog audio signal. Specifically, the system control section 10 sends various control commands that contain sound parameters associated with musical instruments, musical scale, and the like, to the DSP 20 so that the DSP 20 can adequately perform predetermined arithmetic processing.

The waveform memory 40 stores a PCM sound source data (referred to as waveform data) fed beforehand via an input/output means (not shown). The waveform memory can be a read only memory (ROM). The waveform data in the waveform memory 40 are composed of different kinds of data for individual musical instruments allocated at respective n-bit memory addresses.

The DSP 20 performs predetermined processing including arithmetic processing of a PCM sound signal read out from the waveform memory 40 to generate a digital signal of electronic sound under the control of the system control section 10, and outputs the resultant signal to the D/A converter 60.

The DSP 20 has a control section 211, a program memory 212, a working memory addressing control means 213, a working memory 214, a waveform memory addressing control means 215, a sum-of-products arithmetic circuit 216, and an output interface 217.

The program memory 212 is provided for storing the procedure that is to be performed in the DSP 20, from which stored control programs are sequentially retrieved upon receipt of a respective control command from the control section 211. The control section 211 controls each component of the DSP 20 so that the DSP 20 as a whole performs desired processing. Specifically, based on a control command received from the system control section 10, a processing program for executing the command is sequentially read out from the program memory 212. Address arithmetic parameters PA for controlling addressing to access the waveform memory 40 for data needed are written to the waveform memory addressing control means 215 as needed. In order to execute desired processing, a sum-of-products command is issued to the sum-of-products arithmetic circuit 216.

The address arithmetic parameters PA held in the waveform memory addressing control means 215 consist of a starting address OFST that indicates the starting point of sound data, an ending address STOP that indicates the end of the sound data, a starting repetitive address REST that indicates the starting point of sound data to be repeated, and a unit address increment PHINC that indicates a unit of address increment. It is noted that the unit address increment PHINC can be any integer and may contain a fractional address below decimal point with respect to a given starting address. Of course, it can be 1, as is usually the case. The parameters PA are determined by the DSP 20, taking account of a relationship of the waveform data needed for the arithmetic performed in the DSP 20 to the waveform data stored in the waveform memory 40.

Figure 7:
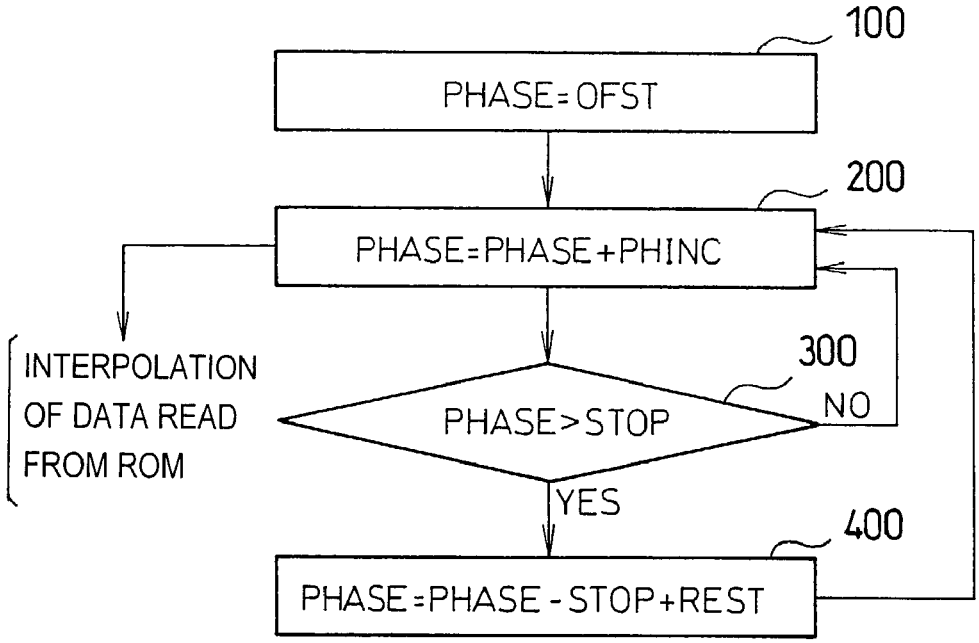
FIG. 7 is a flowchart of operations shown in FIG. 6.
Figure 8:
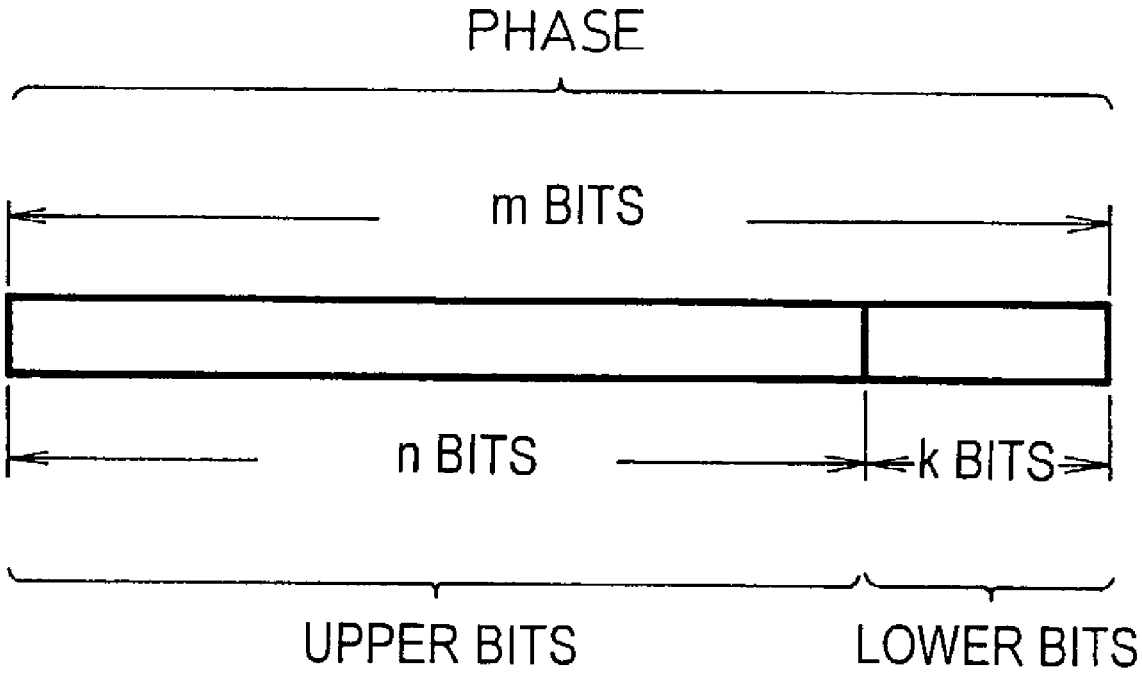
FIG. 8 is a diagram illustrating a result of address arithmetic.

The waveform memory addressing arithmetic circuit 30 receives address arithmetic parameters PA including a starting address OFST, an ending address STOP, a starting repetitive address REST, and unit address increment PHINC from the waveform memory addressing control means 215 of the DSP 20. Operations of the waveform memory addressing arithmetic circuit 30 will be described with reference to FIG. 6 illustrating operations of the waveform memory address arithmetic circuit and a flowchart of FIG. 7, and FIG. 8 showing the result of arithmetic processing.

Figure 6:
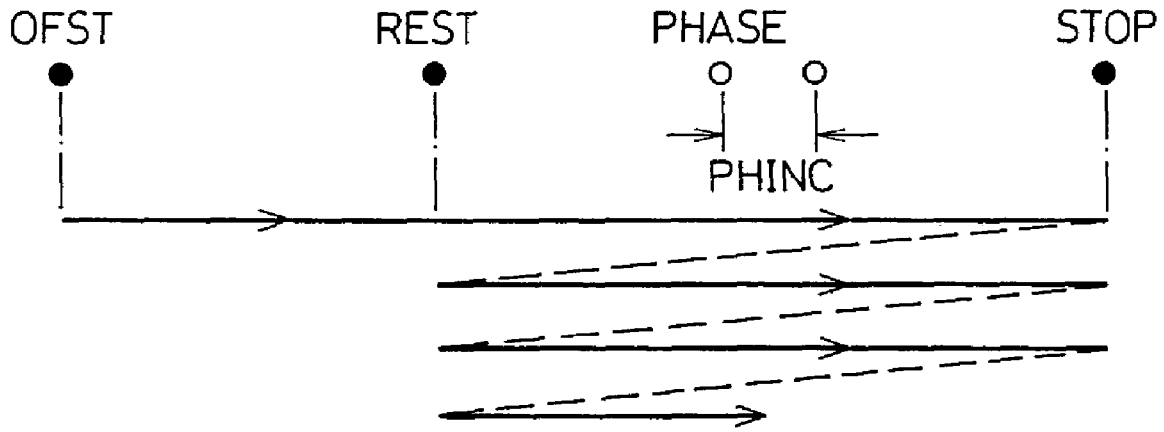
FIG. 6 is a diagram illustrating operations of the waveform memory address arithmetic circuit shown in FIG. 5.

Shown in FIG. 6 are address arithmetic operations involving repetitive loops for the beginning of a tone. Referring to FIG. 7, there is shown a procedure that starts with step 100 in which a starting address OFST is supplied as the current address PHASE. In the next step 200, unit address increment PHINC is added to the current address PHASE to obtain the next current address PHASE.

In step 300, the current address PHASE is compared with the ending address STOP to see if PHASE<STOP or not. If it is, then the procedure returns to step 200 to add unit address increment PHINC to the current address PHASE.

If PHASE>STOP in step 300, the procedure proceeds to step 400, where ending address STOP is subtracted from the current address PHASE, and the starting repetitive address REST is added to obtain a new current address PHASE. The new current address PHASE turns out to be substantially the same address as the starting repetitive address REST. Address addition is repeated with reference to the new current address PHASE. It is noted that the new current address PHASE is set to be substantially the same as the starting repetitive address REST, because the unit address increment PHINC is not necessarily equal to 1 but rather some integer other than 1 or a fractional number in the invention.

In this manner, the current address PHASE is output every time an arithmetic processing is performed in the waveform memory addressing arithmetic circuit 30 in step 200. The resultant current address PHASE consists of upper n bits (including MSB) and lower k bits (including LSB), as illustrated in FIG. 8. In other words, the current address PHASE has an m-bit address, where m=n+k. A reason for allowing the current address to include the k lower bits is to permit the current address to have a fractional address increment as unit address increment PHINC.

While the upper n bits of the m bits are supplied as the address of the waveform memory 40, the lower k bits are supplied to the waveform data interpolation processing circuit 50.

The waveform data addressed by the address supplied from the waveform memory addressing arithmetic circuit 30 is read out from the waveform memory 40, and is supplied to the waveform data interpolation processing circuit 50. In this case, subsequent waveform data and/or the preceding waveform data may be read out together with the waveform data addressed by the address as needed in the method of interpolation carried out by the waveform data interpolation processing circuit 50, depending on the internal structure of the waveform data interpolation processing circuit 50.

In the waveform data interpolation processing circuit 50, a suitable waveform data associated with the current address PHASE represented by the m bits (m=n+k) is obtained by a linear interpolation of the waveform data addressed by the upper n bits and the waveform data addressed by the next address based on the value of the lower k bits, i.e. the value of the address below decimal point. It should be understood that the interpolation is not limited to be linear. Alternatively, any other known technique, for example weighted filtering of multiple waveform data, can be uses as well.

The D/A converter 60 converts the digital signal of electronic sound supplied from the DSP 20 into an analog signal, which can be output from a speaker.

Next, operations of the electronic sound generator will be described. The waveform memory 40 stores waveform data for individual musical instruments in respective n-bit memory addresses. The allocation of the data is managed by the DSP 20.

The system control section 10 sends a predetermined control command to the DSP 20 in order to have the DSP 20 provide desired musical signal. In the DSP 20, the cotrol section 211 sets up address arithmetic parameters PA such as starting address OFST, ending address STOP, starting repetitive address REST, unit address increment PHINC for the waveform memory 40 in the parameter register of the waveform memory addressing control means 215, in accordance with the control command.

When the system control section 10 instructs the DSP 20 to start generating a sound, the control section 211 reads out a processing program from the program memory 212 in accord with the command and begins desired processing.

Specifically, address arithmetic is performed in the waveform memory addressing arithmetic circuit 30 based on the address arithmetic parameters PA set. The upper n bits of the current address PHASE obtained is fed to the waveform memory 40 as the upper bit address to read out the waveform data and the subsequent (and/or preceding) waveform data for the address, which waveforms are supplied to the waveform data interpolation processing circuit 50. On the other hand the lower k bits of the current address PHASE obtained are supplied to the waveform data interpolation processing circuit 50 as the lower bit address below decimal point.

In the waveform data interpolation processing circuit 50, a desired tone waveform data is generated by interpolating the two or more of the waveform data read out from the waveform memory in accordance with the upper bit addresses, using the lower bit addresses of the corresponding upper bit addresses, i.e. data below decimal point. The interpolated waveform data is supplied to the sum-of-products arithmetic circuit 216.

Figure 9:
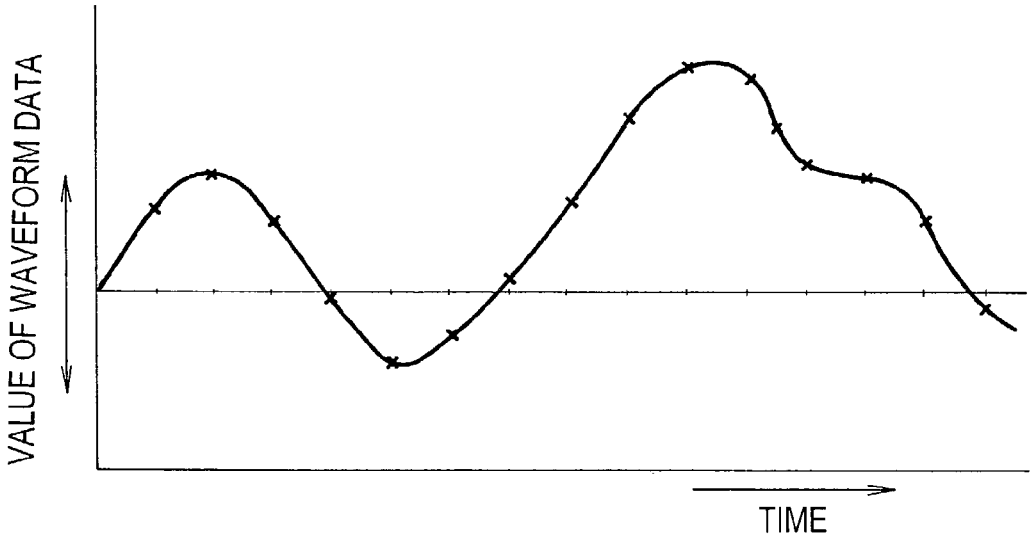
FIG. 9 shows a result of waveform processing according to the invention.
Figure 9:
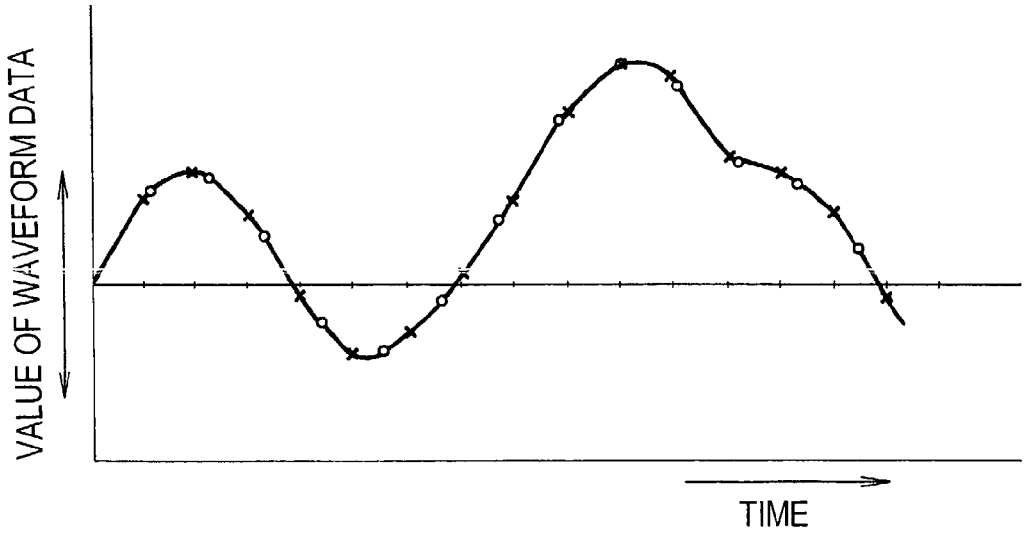

Referring to FIG. 9, an example of interpolated waveform data will be described below. FIG. 9(*a*) shows a sequence of waveform data (each marked by x) stored in the waveform memory 40 in the order of increasing address with the unit incremental address PHINC being 1.0. This is a waveform obtained by plotting the waveform data stored in the waveform memory 40 and output from the waveform data interpolation processing circuit 50 without interpolation.

FIG. 9(*b*) shows a sequence of waveform data read out from the waveform memory 40 with the unit address increment PHINC being 1.1. In this instance, since the speed of reading addresses is faster, a waveform output from the waveform data interpolation processing circuit 50 has a higher frequency. The waveform data read out from the waveform memory 40 are marked by x in FIG. 9(*b*), while data marked by circle are interpolated waveform data output from the waveform data interpolation processing circuit 50.

In this way, the interpolation is executed for two or more of the waveform data read out from the waveform memory 40 based on the upper n-bit addresses using the lower k-bit address of the current address PHASE as data for an interpolation below decimal point. The new sequence of waveform data output from the waveform data interpolation processing circuit 50, different from the sequence of waveform data stored in the waveform memory 40, are supplied to the DSP 20.

In the example shown in FIG. 9(*b*), the unit address increment is 1.1. Alternatively, it can be 0.7 or 1.5, or any other number having a fraction below decimal point. By selecting an appropriate unit address increment PHINC, the waveform data stored in the waveform memory 40 can be used as a source for obtaining various waveforms by means of the waveform memory addressing arithmetic circuit 30 and the waveform data interpolation processing circuit 50.

The waveform data obtained by interpolating by the waveform data interpolation processing circuit 50 and the waveform data read out from the waveform memory 40 are sequentially input to the sum-of-products arithmetic circuit 216, where the waveform is further reshaped through pitch processing, filtering, reverberation processing, and volume processing.

Data other than those needed to perform such further processing and temporary data associated with them are written to and read from the addresses of the working memory 214 that are managed by the working memory addressing control means 213.

Final version of the digital signal of electronic sound is generated in the sum-of-products arithmetic circuit 216 and output therefrom to the D/A converter 60 via the output interface 217. The D/A converter 60 converts the digital sound signal into an analog signal to be output from the electronic sound generation device. The output may be then used to reproduce the sound.

Thus, the second electronic sound generation device of the invention is provided with the waveform memory addressing arithmetic circuit 30 and the waveform data interpolation processing circuit 50 in addition to the DSP 20. Therefore, special processing means such as an address generation circuit or an address arithmetic circuit for the waveform memory 40 are not necessary for the DSP 20 any longer. Thus, using a general purpose DSP, it is possible to generate various kinds of sounds using other than the data stored in the waveform memory.

It is noted that in this embodiment the address arithmetic parameters PA additionally include, along with starting address and ending address, unit address increment PHINC that can assume any magnitude as needed. It will be recalled that this unit address increment enables interpolation of waveform data below decimal point (lower bits) of the integral waveform data (upper bits) read out from the waveform memory, thereby enabling generation of a rich tone.

It will be understood that the DSP can be specialized for use in sum-of-products arithmetic directly related to timbre processing and that it can facilitate generation of rich sound. Because it is operable at a low operating frequency, power consumption thereof may be effectively reduced, especially in portable devices.

It will be understood that not only the system control section 10 and DSP 20 but also the waveform memory addressing arithmetic circuit 30, waveform memory 40, waveform data interpolation processing circuit 50 and D/A converter 60 can be either formed as independent LSIs or integrated in an LSI in combination.

As a third embodiment, in place of the waveform memory 40 of the first embodiment (FIG. 3), a combination of the waveform memory addressing arithmetic circuit 30, waveform memory 40, and waveform data interpolation processing circuit 50 of the second embodiment (FIG. 5) can be used.

What I claim is:

1. An electronic sound generation device, comprising:

a waveform memory storing waveform data;

a digital signal processing circuit for starting, upon receipt of a start signal for starting arithmetic processing, predetermined arithmetic processing based on sound parameters and waveform data supplied from said waveform memory, outputting an in-operation signal indicating that said digital signal processing circuit is in operation during said arithmetic processing, and outputting resultant data of said arithmetic processing when said arithmetic processing is completed;

a sampling signal generation circuit for periodically outputting a sampling signal with a constant period;

a synchronized ON/OFF circuit receiving said periodic sampling signal and said in-operation signal, said ON/OFF circuit adapted to supply said digital signal processing circuit with a start signal for starting next arithmetic processing in synchronism with said sampling signal in the event that said predetermined arithmetic processing has been completed at the time said sampling signal is received but otherwise supply said start signal after said predetermined arithmetic processing is completed; and an arithmetic result output circuit for holding said resultant data of arithmetic processing supplied from said digital signal processing circuit and for outputting said resultant data as a sound data in synchronism with said sampling signal.

2. The electronic sound generation device according to claim 1, wherein said in-operation signal is a signal indicating the end of arithmetic processing issued when said predetermined arithmetic processing is completed.

3. The electronic sound generation device according to claim 1, wherein said resultant data of arithmetic processing held in said arithmetic result output circuit is overwritten with new resultant data of arithmetic processing.

4. A portable device, equipped with an electronic sound generation device according to claim 1.

* * * * *